US006367082B1

(12) United States Patent
Mina

(10) Patent No.: US 6,367,082 B1
(45) Date of Patent: Apr. 9, 2002

(54) MICROFIBER NON-WOVEN FABRIC BATHROBE

(76) Inventor: Emilio Mina, Via Giovanni Milani, 11, 20133 Milan (IT)

( * ) Notice: Subject to any disclaimer, the term of this patent is extended or adjusted under 35 U.S.C. 154(b) by 0 days.

(21) Appl. No.: 09/655,980

(22) Filed: Sep. 6, 2000

(30) Foreign Application Priority Data

Sep. 9, 1999 (IT) ..... MI99U0561

(51) Int. Cl.[7] ..... A41B 9/00; A41D 5/00
(52) U.S. Cl. ..... 2/69; 2/67; 2/83
(58) Field of Search ..... 2/67, 83, 69

(56) References Cited

U.S. PATENT DOCUMENTS 3,751,730 A * 8/1973 Zamist ..... 2/114
4,041,203 A * 8/1977 Brock et al. ..... 428/157
4,852,187 A * 8/1989 Johansson ..... 2/69
5,244,724 A * 9/1993 Antonacci et al. ..... 442/414
5,460,884 A * 10/1995 Kobylivker et al. ..... 428/373
5,759,926 A * 6/1998 Pike et al.
5,770,529 A * 6/1998 Dennis et al. ..... 422/268
5,970,583 A * 10/1999 Groten et al. ..... 19/296

* cited by examiner

*Primary Examiner*—John J. Calvert
*Assistant Examiner*—Robert H. Muromoto, Jr.
(74) *Attorney, Agent, or Firm*—Hedman & Costigan, P.C.

(57) ABSTRACT

A bathrobe which is made from a non-woven micro fiber fabric, which has a high water absorption capability, a low volume and a weight from 200 to 400 g for a standard user size bathrobe. The non woven fabric has 50% polyester micro fibers and 50% polyamide micro fibers blended as to provide a non-woven construction which can absorb a weight of water up to 400% based on the weight of the bathrobe.

2 Claims, 2 Drawing Sheets

MICROFIBER NON-WOVEN FABRIC BATHROBE

BACKGROUND OF THE INVENTION

The present invention relates to a bathrobe, made of a microfiber non-woven fabric.

A drawback of prior bathrobes made of conventional fabrics, is that they occupy a comparatively high volume and have a comparatively high weight.

The greater is the absorption capability of the bathrobe, the greater the weight and volume will be.

This drawback is particularly annoying as the bathrobe must be transported in a bag, for example for swimming pool, sea uses and so on.

SUMMARY OF THE INVENTION

The main object of the present invention is to provide such a bathrobe construction obviating the above mentioned drawbacks.

Another object of the present invention is to provide such a bathrobe construction which has a very small volume and weight.

Another object of the present invention is to provide such a bathrobe construction, which has a high absorption capability, while having a small volume.

According to one aspect of the present invention, the above objects, as well as yet other objects, are achieved by a bathrobe, characterized in that said bathrobe is made of a non-woven fabric.

BRIEF DESCRIPTION OF THE DRAWINGS

Further characteristics and advantages of the invention will become more apparent hereinafter from the following detailed disclosure of the bathrobe according to the invention, which is illustrated, by way of an indicative, but not limitative, example in the accompanying drawings, where.

DESCRIPTION OF THE PREFERRED EMBODIMENT

Figure 1:
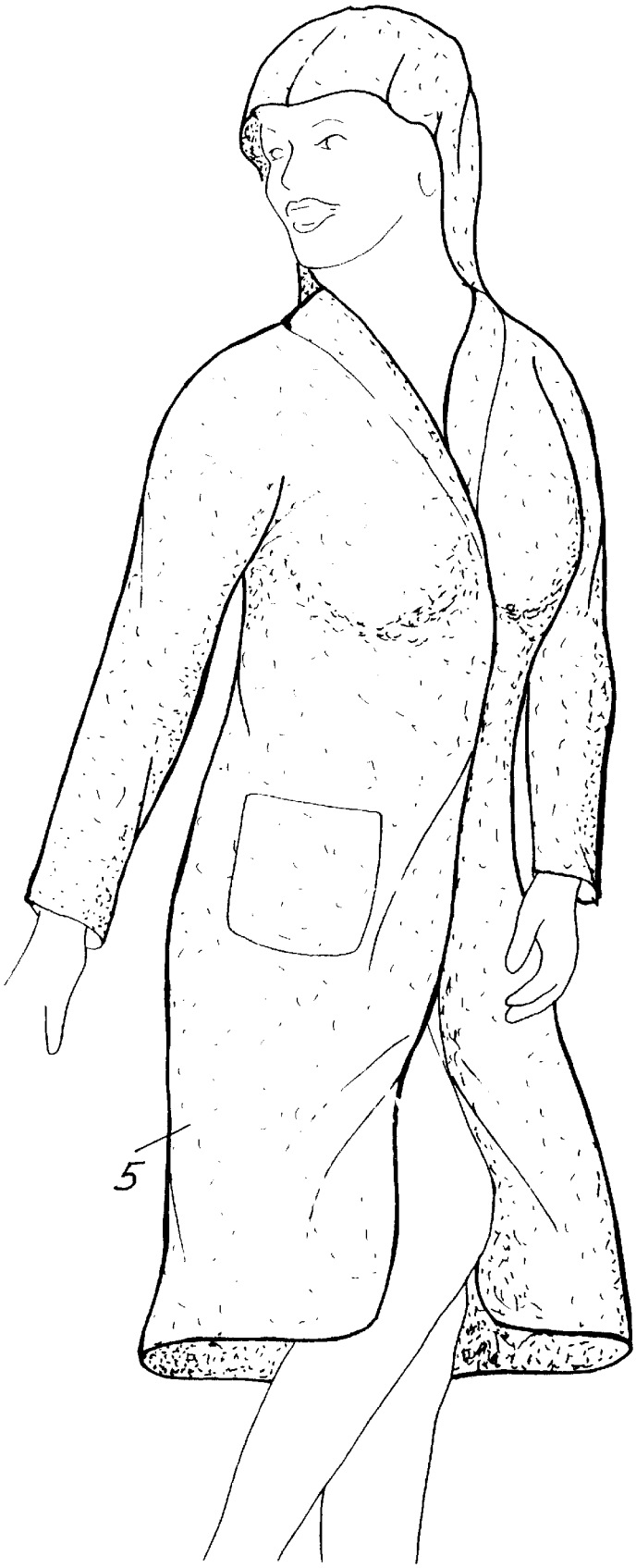
FIG. 1 is a schematic perspective view of the bathrobe according to the invention.
Figure 2:
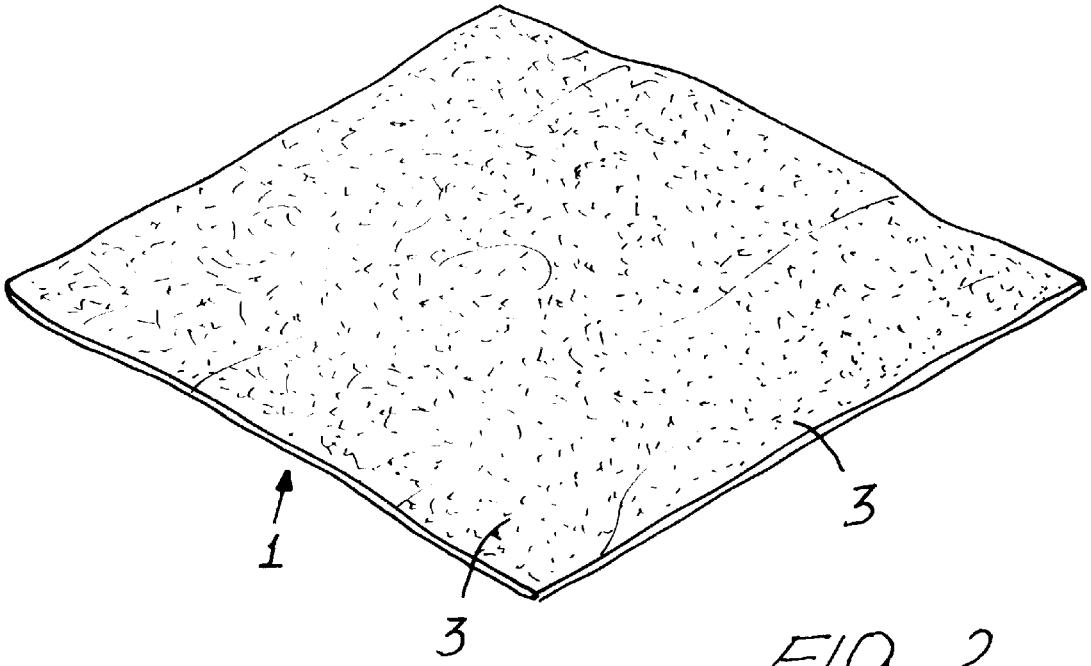
FIG. 2 is a schematic partial view of the bathrobe construction.
Figure 3:
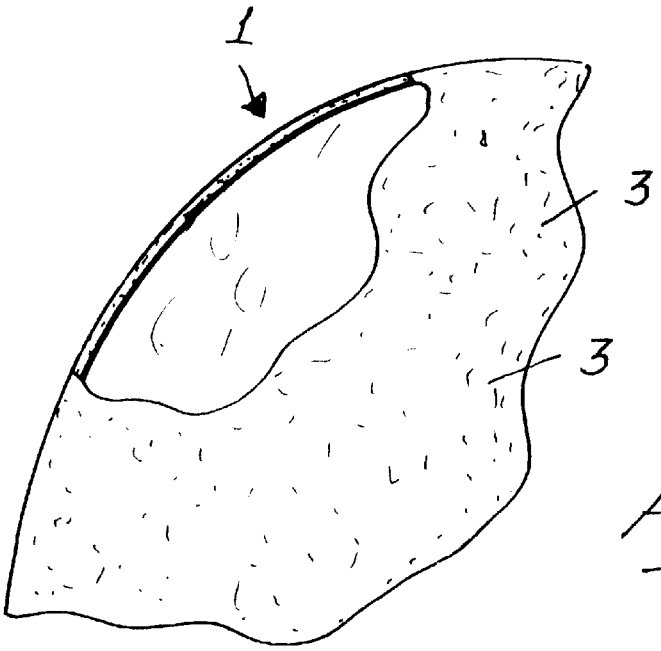
FIG. 3 is a further schematic partial view of the bathrobe, as partially cross-sectioned.

With reference to the number references of the figures of the accompanying drawings, the bathrobe construction according to the invention, generally indicated by the reference number 1, comprises a non-woven fabric, including microfibers, indicated by the reference number 3.

Said microfibers advantageously comprise 50% polyester microfiber and 50% polyamide microfibers.

In this connection it should be apparent that both said polyester and polyamide microfibers can also be used either individually and/or in different rates.

Said microfibers, moreover, can be associated with other fibers and/or microfibers.

The thus formed non-woven fabric is able of absorbing a weight of liquid up to 400% the weight of the fabric.

Thus, it should be apparent that the bathrobe construction according to the invention has a very small weight, with respect to a conventional prior bathrobe, the latter being suitable to absorb a much smaller water amount.

By way of an example, the bathrobe 5, made by the subject non-woven fabric material, has an indicative weight from 200 to 400 g related to a standard size of the bathrobe.

It is to be pointed out that the non-woven fabric forming the subject bathrobe comprises a number of microfibers varying from 6,000 to 15,000/cm$^2$.

Moreover, the bathrobe according to the present invention has a smaller size than that of a like conventional bathrobe, thereby the inventive bathrobe can be easily transported.

The non-woven fabric forming the bathrobe according to the invention has been found as advantageous with respect to the effects thereof on the skin of the user, since it provides a "massage" type of action, as well as a dead cells removing action.

Thus, it should be apparent that the invention fully achieves the above mentioned objects.

In practicing the invention, the used materials and size can vary, according to requirements and the status of the art.

What is claimed is:

1. A bathrobe, wherein said bathrobe comprises a non-woven micro fiber fabric, having a high water absorption capability, a low volume and a bathrobe weight from 200 to 400 g for a standard user size bathrobe, the non-woven micro fiber comprising 50% polyester micro fibers and 50% polyamide micro fibers so blended as to provide a non-woven construction absorbing a water weight up to 400% of the bathrobe weight.

2. A bathrobe according to claim 1, wherein said non-woven fabric comprises from 6,000 to 15,000 polyester and polyamide microfibers/cm$^2$.

* * * * *